US005219021A

United States Patent [19]

Edelstein et al.

[11] Patent Number: 5,219,021

[45] Date of Patent: Jun. 15, 1993

[54] LARGE CAPACITY RE-ENTRANT GROOVE HEAT PIPE

[75] Inventors: Fred Edelstein, Hauppauge; Robert L. Kosson, Massapequa, both of N.Y.

[73] Assignee: Grumman Aerospace Corporation, Bethpage, N.Y.

[21] Appl. No.: 778,263

[22] Filed: Oct. 17, 1991

[51] Int. Cl.[5] ..... F28D 15/02

[52] U.S. Cl. ..... 165/104.26; 122/366

[58] Field of Search ..... 165/104.26; 122/366

[56] References Cited

U.S. PATENT DOCUMENTS 3,537,514 11/1970 Levedahl ..... 165/104.26

4,004,441 1/1977 Leszak ..... 165/104.26

4,457,059 10/1985 Alario et al. ..... 165/104.26

4,545,427 10/1985 Alario et al. ..... 165/104.26

*Primary Examiner*—Albert W. Davis, Jr.

*Attorney, Agent, or Firm*—Pollock, VandeSande & Priddy

[57] ABSTRACT

A re-entrant groove heat pipe provides capillary channel fin surfaces which are smooth, continuous, and offer a large radius of curvature upon which an extended thin film of working liquid may develop. Superior formation of thin films of the working fluid allows heat to be conducted more readily between the surface of the heat pipe and the surface of the fluid where evaporation and condensation takes place.

2 Claims, 3 Drawing Sheets

LARGE CAPACITY RE-ENTRANT GROOVE HEAT PIPE

BACKGROUND OF THE INVENTION

The present invention relates to heat pipes, and in particular to heat pipes formed by the extrusion of a thermally conductive material through a die resulting in an axially grooved pipe of the re-entrant type.

Conventional heat pipes operate to transfer heat from a heat source, where heat energy is produced or collected, to a heat sink, where the heat is stored or removed. The usual configuration is a closed chamber containing a working fluid which absorbs heat by evaporation and releases heat by condensation in a continuous cycle. Thus, the heat pipe may be characterized as having three sections: (1) an evaporator, located in the heat source region; (2) a condenser in the heat sink region; and (3) a transport section through which vaporized and liquid working fluid flow from the evaporator to the condenser and back.

A persistent problem in the design of heat pipes has been the provision of satisfactory means for moving the liquid working fluid from the condenser to the evaporator. Generally, such means comprise capillary flow channels in or along the walls of the heat pipe, while the central region of the pipe's cross section is reserved for vapor flow in the opposite direction.

U.S. Pat. No. 3,402,767, issued to Bohdansky, et al., discloses a heat pipe having a plurality of narrow axial grooves which by themselves serve as capillary channels to transport the condensed working fluid, avoiding the problems of a separate wicking element. However, the rectangular groove profile of Bohdansky is inefficient with respect to both the channelling of the condensed working fluid into the capillary grooves in the condenser area and in the transfer of heat through the working fluid, especially when the fluid has, as is typical, a low thermal conductivity.

The problem of optimizing the groove profiles for the evaporator, condenser, and transport sections of an axially grooved heat pipe is addressed by U.S. Pat. Nos. 3,528,494 and 3,537,514, both issued to Levendahl. In essence, Levendahl proposes a distinct profile for each section of the heat pipe. An inner wall similar to that of Peck is suggested for use in the transport section only, so as not to impair the evaporator and condenser efficiencies. Levendahl further recognizes the effect on evaporator/condenser efficiency of varying the radius of curvature of the axial groove entrances. However, the Levendahl configuration requires that the individual evaporator, condenser, and transport sections be formed separately and subsequently joined together, thus introducing considerable production costs.

In fact, production costs present a major obstacle in the design of an optimum groove profile. U.S. Pat. No. 3,566,651, issued to Tlaker, discloses a method for forming tubular parts by material displacement of the interior walls of a blank workpiece or pipe. Such deformation is accomplished by feeding the blank tube past a tapered mandrel and appropriately shaped die positioned within the tube. Another well known method for forming tubular parts is extrusion, which entails the feeding of the material from which the tube is formed past a die suspended by spider legs. The material is fed past the die in a semi-molten state, and fuses together as it passes the spider arms.

Both the Tlaker material displacement and the extrusion methods, while desirable from a low production cost standpoint, are limited with respect to the complexity of the axial groove configurations which may be formed thereby.

In U.S. Pat. No. 4,545,427 which issued Oct. 8, 1985, and is assigned to the present assignee, a re-entrant groove heat pipe is disclosed which provides an improvement of the previous axial groove configuration. In the patented device a heat pipe is provided which has a plurality of axial convergent re-entrant grooves. Capillary flow in the heat pipe is assured by the use of a capillary channel having a re-entrant groove or opening which is narrower than the central portion of the channel itself. The re-entrant groove may be readily produced by extrusion methods. However, the re-entrant groove profile must then be modified by passing a mandrel having a plurality of serrations in registry with the re-entrant grooves through the heat pipe. This modification results in a narrower entrance with tapering or convergent surfaces leading to the groove itself. The narrower entrance allows a reduction in working fluid inventory over the unmodified re-entrant groove. The convergent entrances bring about improved fluid flow into the capillary channels in the condenser section and supply appropriate surfaces in the evaporator section for the formation of thin films of working fluid to allow heat to be conducted more readily from the surface of the heat pipe to the surface of the fluid where evaporation takes place. Although the patented device operates generally satisfactorily, there is a constant demand for more thermally efficient heat pipe structures and reduced machining and modification costs after extrusion. Further, there are continuing requirements for heat pipes with reduced internal pressure as well as a reduction of pipe wall thickness. This is particularly attractive for cryogenic applications.

BRIEF DESCRIPTION OF THE PRESENT INVENTION

The present invention is an improvement over the last discussed prior patented device disclosed in U.S. Pat. No. 4,545,427. In particular, the present invention includes improved design in the geometry of the fins between adjacent axial grooves of the heat pipe. The improvement of the present invention permits greater areas of thin film working fluid to develop, which increases the thermal efficiency of the heat pipe.

By virtue of the present invention, a heat pipe structure is easily fabricated from stock extrusion tubing requiring minor machining.

The present invention also offers a higher thermal capacity than conventional heat pipes for the same charge of working fluid.

The present design is quite attractive for cryogenic applications because the internal pressure and necessary pipe wall thickness are reduced.

The invention is tolerant to the presence of non-condensable gas, as compared with other heat pipe structures.

The rounded fin tip shape characterizing the geometry of the present heat pipe configuration improves the heat transfer coefficients relative to the prior art. Further, if aluminum or a similar metal is used, the heat pipe is easily bendable.

BRIEF DESCRIPTION OF THE FIGURES

The above-mentioned objects and advantages of the present invention will be more clearly understood when considered in conjunction with the accompanying drawings, in which.

DETAILED DESCRIPTION OF THE INVENTION

Figure 1:
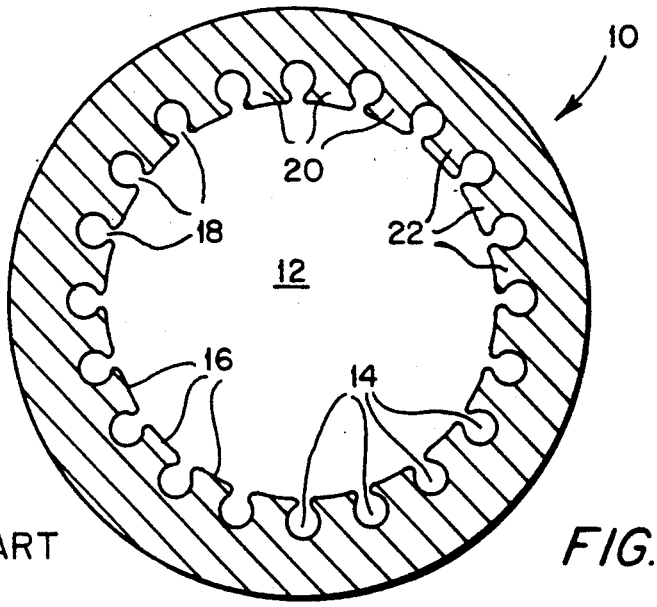
PRIOR ART FIG. 1
FIG. 1 is a cross section of a prior art re-entrant groove heat pipe.

Prior to a discussion of the improved heat pipe design, it will be instructive to discuss the most relevant prior art, as shown in FIGS. 1-4. FIG. 1 shows, in cross section, a prior art commercially available extruded tube 10 which may be cut to a desired length, sealed at either end, as by crimping and/or welding, and injected with a suitable coolant or working fluid to form a heat pipe. A vapor flow channel 12 is enclosed by the wall of the tube 10, while a plurality of capillary or fluid flow channels 14 are formed within the wall itself. Each channel 14 is defined by an adjacent pair of parallel ribs 16 projecting inwardly toward the central vapor flow channel 12. A plurality of re-entrant groove openings 18 in one-to-one correspondence with channels 14 provide communication between channels 14 and channel 12. Each rib 16 has a head portion 20 which is relatively thicker than the rib's base portion 22, resulting in a re-entrant profile wherein openings 18 are narrower than capillary channels 14.

Figure 2:
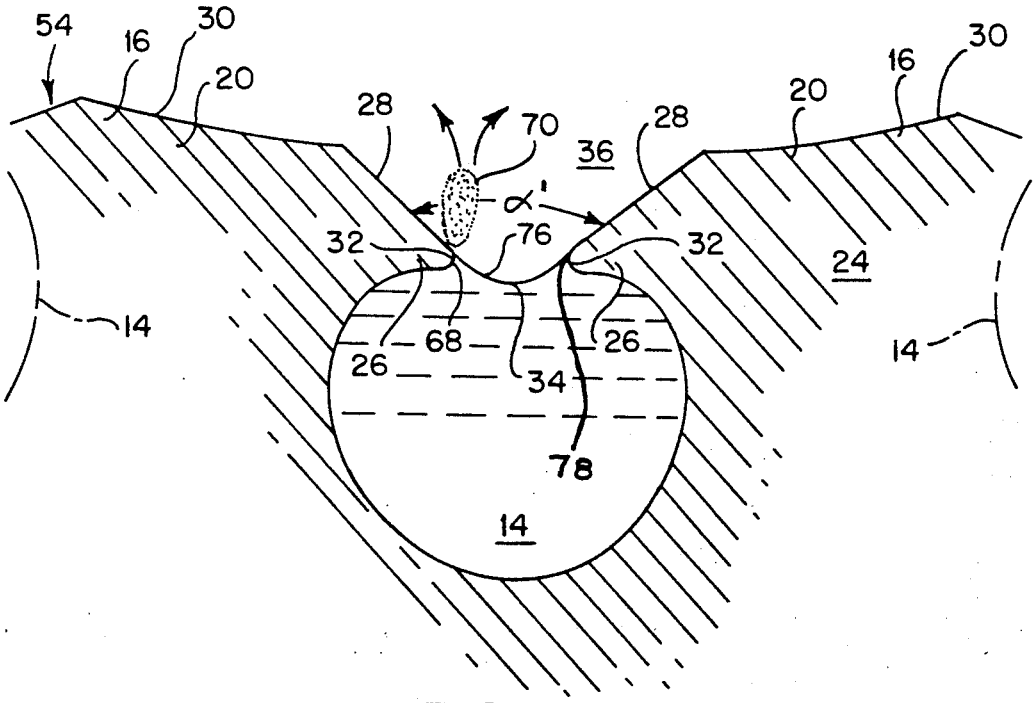
FIG. 2 PRIOR ART
FIGS. 2 and 3 are cross-sectional views of the most relevant prior art re-entrant groove heat pipe.
Figure 3:
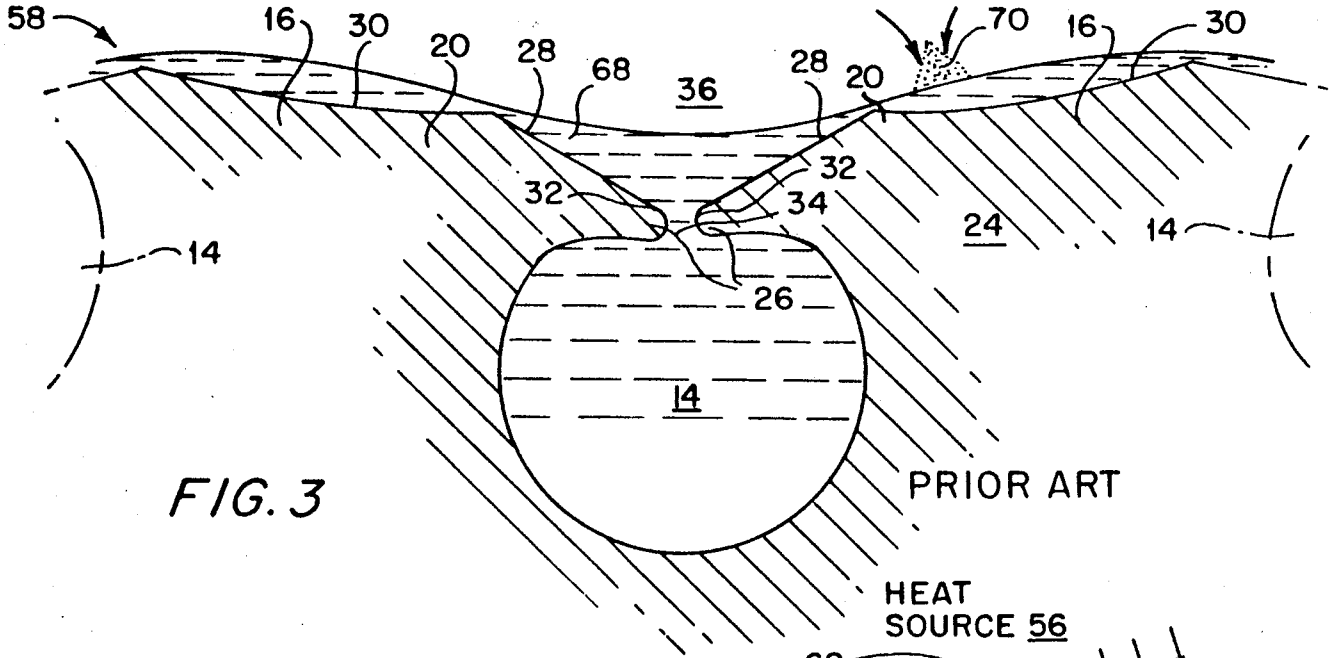

FIGS. 2 and 3 show partial cross sections of a heat pipe 24 formed from a tube 10 which has been modified according to U.S. Pat. No. 4,545,427. As modified, each rib 16 includes a pair of transverse fins 26 projecting from opposite sides of head portion 20. Each adjacent pair of ribs 16 thus includes a facing pair of transverse fins 26 which project toward each other.

Each transverse fin 26 provides a flat sloping surface 28 extending from inner surface 30 of associated rib 16 to a tip 32 of the fin. The resulting re-entrant groove profile includes modified, narrowed groove openings 34 with convergent entrances 36. Each facing pair of transverse fins 26 borders an associated opening 34, while the sloping surfaces 28 of a facing pair of fins defined the convergent entrance 36 to the associated channel 14. According to the patented device, the convergent re-entrant groove profile is achieved by modifying the commercially available, extruded tube 10 of FIG. 1 with a mandrel and draw bar as discussed in the patent.

Figure 4:
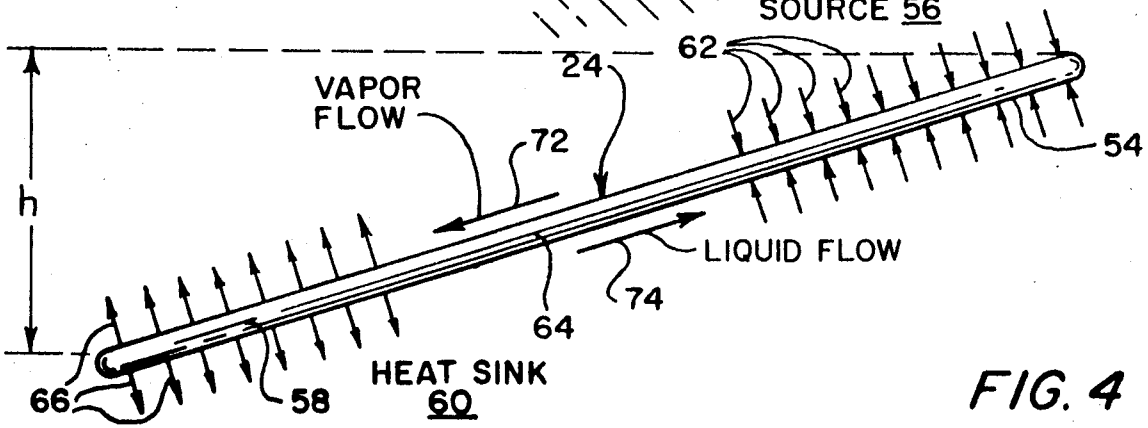
FIG. 4 is a schematic view of the re-entrant groove heat pipe illustrated in FIGS. 2 and 3.

The operation of the prior art heat pipe 24 is shown schematically in FIG. 4. Structurally, heat pipe 24 is a sealed chamber formed from a modified length of re-entrant groove tube in the same manner as prior art heat pipes would be formed from virgin extrusions.

The heat pipe 24 is positioned so that one end, the evaporator 54, is located in a heat source region 56 and the other end, condenser 58, is in heat sink region 60. Heat is absorbed as indicated by arrows 62, conducted through transport region 64, which may be insulated, and heat is given off as indicated by arrows 66.

Absorption of thermal energy in the evaporator 54 causes evaporation of a working fluid 68 (FIG. 2) while condensation of vaporized working fluid 70 in the condenser section 58 effects a release of thermal energy (FIG. 3). Vapor channel 12 serves to conduct vaporized fluid 70 from evaporator 54 to condenser 58 and capillary channels 14 bring condensed fluid 68 from the condenser back to the evaporator. Arrows 72 and 74 (FIG. 4) indicate the direction of vapor and fluid flow through the heat pipe 24.

While FIG. 4 illustrates the case where heat is conducted from a higher heat source to a relatively lower heat sink, as indicated by adverse tilt "h," heat pipes constructed according to the present invention could also be used to conduct heat from a relatively lower source to a higher sink. In this latter situation, gravity would tend to assist the flow of condensed working fluid. Otherwise, the utility of the heat pipe is limited by its static wicking height, which is the maximum adverse tilt, or vertical difference separating a higher source from a lower sink, at which the heat pipe will operate.

Referring to the prior art structure of FIG. 2, working fluid 68 is seen to form a concave meniscus 76 in each convergent entrance 36 in evaporator section 54. It is at the tips 78 of each meniscus that working fluid layer is thinnest. As is known in the art, heat transfer is improved by providing a thin layer of working fluid, because heat must pass through the working fluid to cause evaporation at the surface, and working fluids generally exhibit a much lower thermal conductivity than the material from which the wall of a heat pipe is formed. Thus, it becomes obvious that the heat transfer properties of the present invention may be altered by adjusting the convergent entrance angle $\alpha'$.

Similarly, angle $\alpha'$ affects the flow of condensed working fluid into groove openings 34. As seen in FIG. 3, vaporized fluid 70 condenses on surfaces 30 in the condenser section 58, and is urged by capillary action along sloping surfaces 28 toward groove openings 34. By conducting the condensed working fluid away from surfaces 30 more efficiently, the present invention affords improved heat transfer in the condenser section. Even further advances in condenser efficiency may be obtained by precisely controlling the profile of inner surfaces 30. As in the evaporator, condenser heat transfer will be improved by providing thin condensation films, since heat from the vapor must be conducted through the film to surfaces 30. Also, an increasing radius of curvature from the midpoint of each surface 30 results in a capillary pumping action of the condensed working fluid toward the re-entrant grooves.

Figure 5:
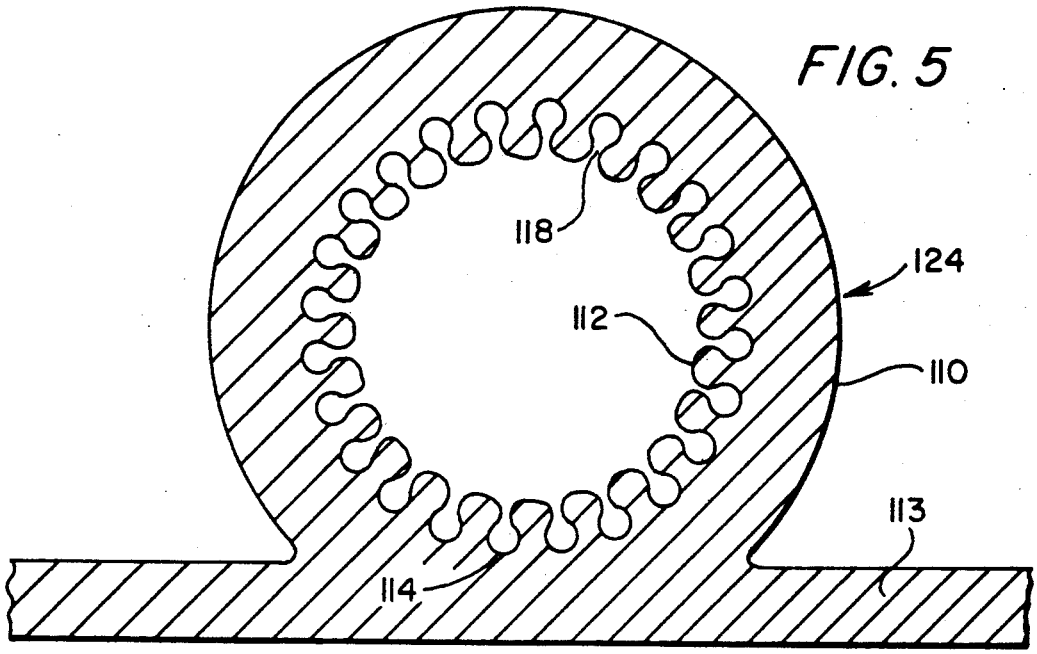
FIG. 5 is a cross-sectional view of an entire heat pipe mounted to a conductive base.
Figure 6:
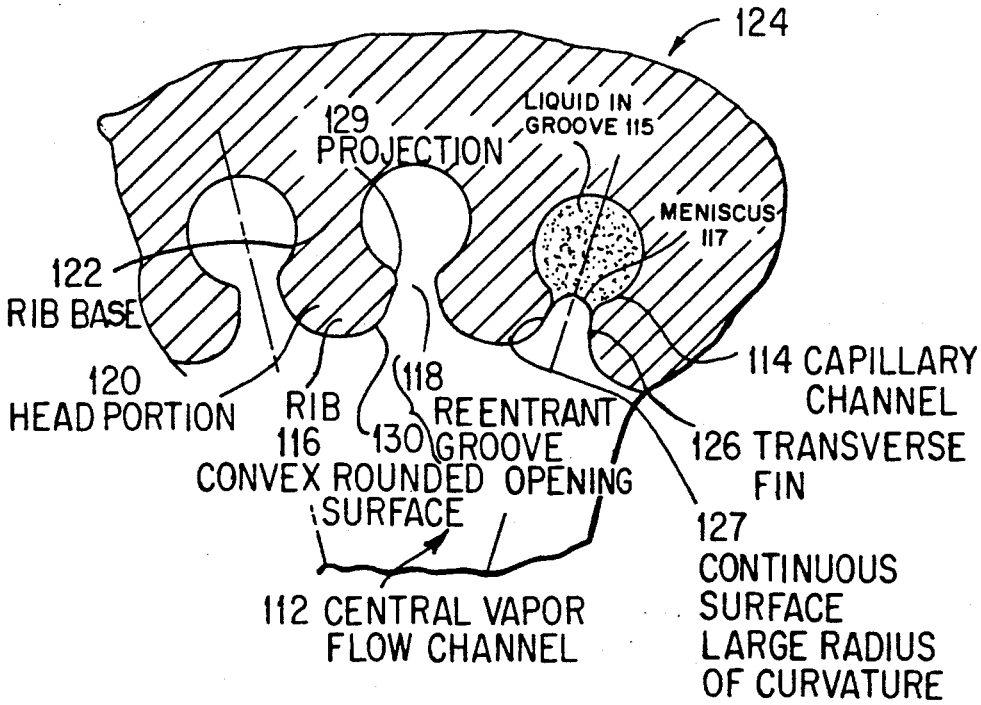
FIG. 6 is a partial sectional view of the heat pipe illustrated in FIG. 5 wherein the geometry thereof is illustrated in detail.

Now considering the improved structure of the present invention, FIG. 5 is a cross-sectional view of a heat pipe fabricated from stock extruded tube 110 which may be cut to a desired length, sealed at either end, such as by crimping and/or welding, and injected with a suitable coolant or working fluid to form a heat pipe 124. A vapor flow channel 112 is enclosed by the wall of the tube while a plurality of capillary or fluid flow grooves or channels 114 are formed within the wall itself. Each channel 114 is defined by an adjacent pair of parallel ribs 116 (FIG. 6) projecting inwardly toward the central vapor flow channel 112. A plurality of re-entrant groove openings 118 in one-to-one correspondence with channels 114 provide communication between channels 114 and the central vapor flow channel 112. Each rib 116 has a rounded head portion 120 which is relatively thicker than the rib's base portion 122, resulting in a re-entrant profile wherein openings 118 are narrower than capillary channels 114. In FIG. 5 the extrusion 110 is indicated as comprising an integral flange 113 which can serve to attach the heat pipe 124 to surfaces requiring heat transfer. Like the heat pipe 124, the flange 113 may be fabricated from aluminum. As in the case of the previously mentioned U.S. Pat. No. 4,545,427, the individual capillary channels 114 may be formed by passing a tool comprising a mandrel and draw bar through the extruded tube. By comparing the structure of the inventive heat pipe (FIG. 6) with that of the most relevant prior art as shown in FIGS. 2 and 3, it will be apparent that the ribs 116 of the present invention have a convex rounded surface 130. This is in marked contrast to the concave nature of the surface 30, as shown in the prior art heat pipe of FIGS. 2 and 3. Further, the transverse fin 126 of the present heat pipe has a smooth and considerably continuous surface 127 with a large radius of curvature extending to the convex surface 129 of smaller radius of curvature. Surface 129 creates a projection; and confronting projections define a narrowed opening of a corresponding re-entrant groove. This is in marked contrast to the prior art wherein the confronting fins 26 are finger-like projections. In the prior art discussed, the tips 78 of each meniscus 76 form a thin layer of working fluid. However, the extent of this layer is limited in the prior art patent due to the discontinuity between sloping surface 28 and surface 30. In marked contrast, the meniscus of the working fluid in the present heat pipe will form along the smooth and substantially continuous surface 127 of the fins 126. Since this surface has a large radius of curvature, a large surface area develops for heat transfer with thin liquid films. Accordingly, the improved design of the present invention offers superior operating results, as compared with the prior art.

It should be understood that the invention is not limited to the exact details of construction shown and described herein for obvious modifications will occur to persons skilled in the art.

I claim:

1. A single section heat pipe comprising:

a cylindrical wall extending along the entire length of the section;

a plurality of axially extending, parallel spaced capillary grooves of arcuate cross-section formed in the wall and located along the entire length of the section;

a central axial channel extending along the entire length of the section;

a plurality of axially extending ribs projecting radially inward, between adjacent grooves, toward the axial channel, wherein each rib includes- (a) a base portion extending from the wall and defining a portion of the groove; and (b) a thicker head portion existing at the radially inward end of each base portion, wherein each adjacent pair of head portions laterally border a relatively narrow re-entrant groove opening, each head portion having

- a radially inward central convex rib surface exhibiting a first fixed radius of curvature;
- a first convex rounded surface, of larger fixed radius of curvature, laterally extending continuously from the central surface of the rib to a corresponding adjacent re-entrant groove, a meniscus extending from each first convex surface; and
- a second convex rounded surface, having a smaller fixed radius of curvature than the first convex rounded surface and located between the first convex surface and a respective groove thereby creating a projection, adjacent projections confronting one another thus defining a narrowed opening of the re-entrant groove.

2. The heat pipe set forth in claim 1 together with working fluid which flows through the capillary grooves in a first axial direction, in liquid form, and in an opposite direction as vapor through the central channel, such that heat is absorbed at one end of the heat pipe and released at another end by respective evaporation and condensation of the working fluid.

* * * * *